United States Patent [19]

Spurr et al.

[11] Patent Number: 4,788,824

[45] Date of Patent: Dec. 6, 1988

[54] ELECTRICAL POWER PLANT AND METHOD OF PRODUCING ELECTRICITY

[76] Inventors: Charles A. Spurr, 3000 Eighth St., Bay City, Tex. 77414; James R. Spurr, 8919 Concho St., Houston, Tex. 77036

[21] Appl. No.: 902,783

[22] Filed: Sep. 2, 1986

[51] Int. Cl.[4] ..... F01K 25/08; F01K 25/10

[52] U.S. Cl. ..... 60/671; 60/651; 60/670

[58] Field of Search ..... 60/651, 671, 670; 126/263

[56] References Cited

FOREIGN PATENT DOCUMENTS 2020372 11/1979 United Kingdom ..... 60/670

*Primary Examiner*—Allen M. Ostrager

*Attorney, Agent, or Firm*—Marett & Marett

[57] ABSTRACT

An apparatus and method of producing electricity comprising passing a low hydrogen content (zero to four percent) air stream over a hydrogenating catalyst in a reaction chamber thereby producing a hot discharge gas which is used to vaporize a liquid hydrocarbon which turns a turbine coupled to a generator.

13 Claims, 1 Drawing Sheet

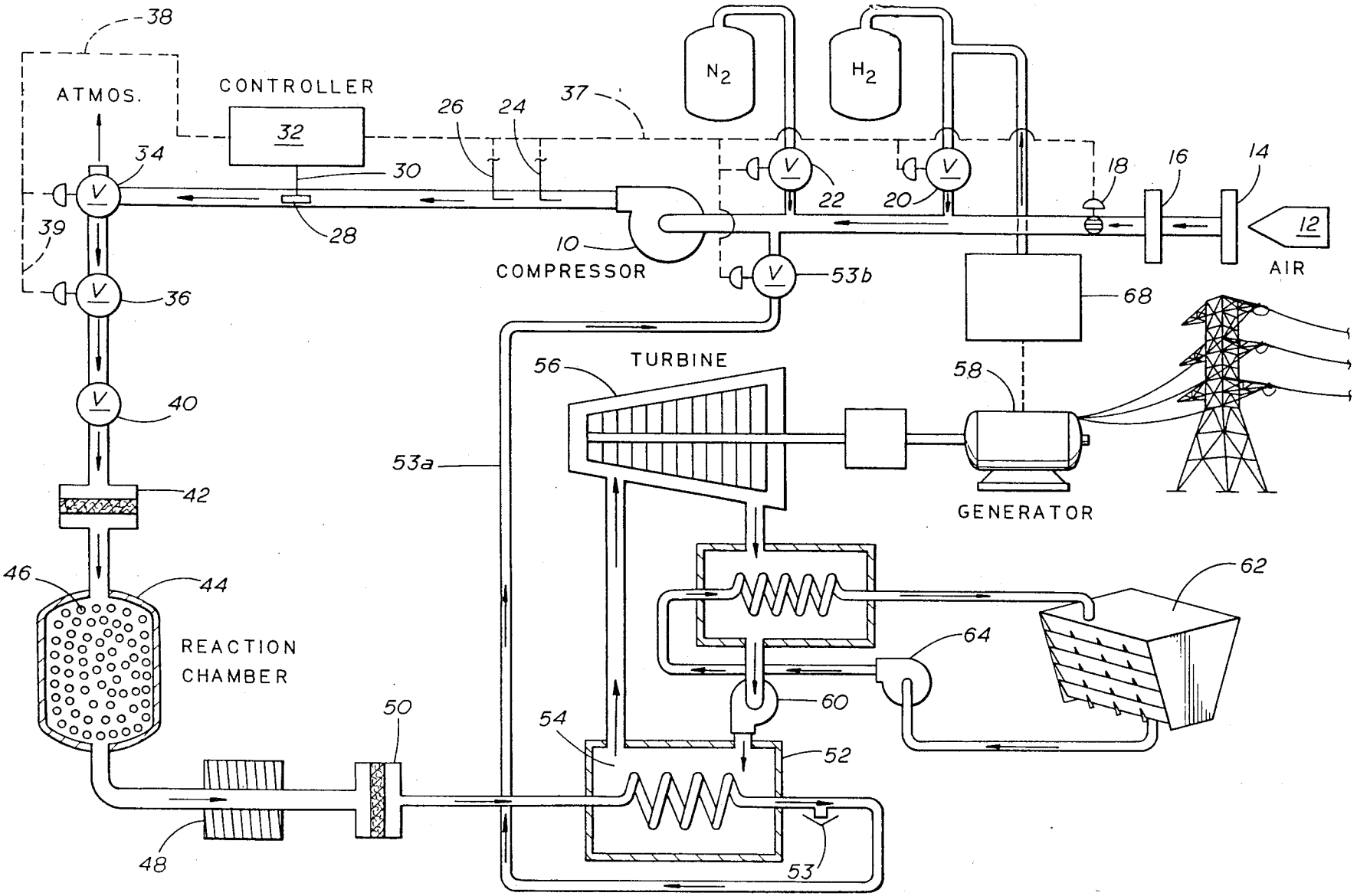
AIR
12
14
16
18
68
62
GENERATOR
58
64
20
$H_2$
22
53b
$N_2$
60
52
53
TURBINE
56
54
37
10
COMPRESSOR
24
26
53a
50
30
28
CONTROLLER
32
REACTION CHAMBER
44
42
40
36
34
38
ATMOS.
39
46
48

ELECTRICAL POWER PLANT AND METHOD OF PRODUCING ELECTRICITY

BACKGROUND OF THE INVENTION

1. Field of the Invention

This invention relates to gas turbine power plants and, more particularly, to a gas turbine power plant using the deoxidized reaction principle.

2. Description of the Prior Art

Various methods of producing electricity are well known in the art. Hydro-electric plants, fossil fuel plants and nuclear power plants have all been used to produce electricity by the use of gas turbines. Similarly, gas turbine power plants are numerous. Representative patents in the general area of this invention are U.S. Pat. Nos. 3,477,228 (Gas Turbine Power Plant); 3,975,913 (Gas Generator and Enhanced Energy Conversion System); 4,388,892 (Process and Apparatus for Generation of Steam via Catalytic Combustion); 3,990,245 (Energy Converter Device); 4,209,992 (Power Generating Method and Apparatus); 4,503,682 (Low Temperature Engine System). Although these systems have been and are being used extensively for the production of electricity, they all have serious drawbacks. Hydro-electric plants are dependent upon a river and a dam for operation. Approval delays from environmental groups and governmental agencies coupled with high construction costs make hydro-electric plants a costly venture. Fossil fuel plants have associated with them the inherent problems of non-renewability of fossil fuel resources and inherent pollution problems. Nuclear power plants are not only expensive and time-consuming, having associated with them also the approval delays from environmental groups and governmental agencies coupled with high construction costs, but also have the obvious danger factors associated with any nuclear reaction. The fuels associated with these power plants are costly to locate and manufacture and produce in sufficient quantities.

Consequently, a need exists for improvements in electrical power plants for the production of electricity which will result in a power plant which is not dependent upon any particular location, would not be subject to environmental and governmental agency approvals, and which can be constructed at reduced levels of capital investments.

SUMMARY OF THE INVENTION

It is, therefore, one of the principal objectives of this invention to provide a method and apparatus for producing electrical power designed to satisfy the aforementioned needs not heretofore produced by the prior art.

In accordance with the invention, described herein, atmospheric air is caused to flow through analyzing and controlling means which produce a low hydrogen to air ratio mixture. A controlled amount of nitrogen gas could also be introduced into the air stream for the purpose of reducing the oxygen content of the air stream. This produces a low $H_2$/air ratio. This low hydrogen to air ratio mixture is then passed into a reaction chamber filled with reactants which cause an exothermic chemical reaction to take place within the reaction chamber producing a discharge air stream at an elevated temperature. This discharge air stream then passes in heat exchange relationship with a working fluid such as a liquid hydrocarbon which evaporates and passes through a turbine which is connected by means of a reduction gear to a generator which then produces the electricity. The method comprises the steps of: drawing into the system a large mass of atmospheric air by means of a compressor, filtering out any dust particles and gases, regulating the amount of air flow based upon system demand, regulating and controlling the hydrogen to air ratio mixture by the use of analyzers and hydrogen and nitrogen flow meters, analyzing the air stream to determine the correct hydrogen and oxygen content, venting the air stream to atmosphere until the proper hydrogen to air ratio is achieved, passing the air stream through a series of check valves and flame arrestors into a reaction chamber filled with a hydrogenating catalysis material, passing the hot gas discharge stream from the reaction chamber through an electro ferrous accumulator removing any ferrous particles in the air stream, passing the hot gas discharge stream through another flame arrestor, preventing heat loss from the hot gas discharge stream, passing the hot gas discharge stream in heat exchange relationship with a liquid hydrocarbon such as freon through an evaporator causing the freon to vaporize, passing the vaporized freon through a turbine which is coupled by means of a reduction gear to a electrical generator, allowing the hot expanding discharge gases from the turbine to pass into a water-cooled heat exchanger which condenses the freon, passing the liquid freon back to the freon evaporator to complete the circuit, and supplying some of the electrical power generated to run a hydrogen generator producing some of the hydrogen needed for the controlling and monitoring steps.

BRIEF DESCRIPTION OF THE DRAWING

The invention will be hereinafter more fully described with reference to the accompanying drawing in which:

FIG. 1 is a schematic representation partly in section of an embodiment of a power plant according to the present invention.

DESCRIPTION OF THE PREFERRED EMBODIMENT

The method of producing electricity according to the present invention begins with compressor 10 drawing in a mass of air 12 into the system. The air 12 is pulled into a filter 14 to remove any dust that may be present in the air. The air is next pulled through a molecular sieve 16 to further filter out any undesirable gases such as carbon monoxide and carbon dioxide which may be present in the air mass 12. The air mass 12 is then passed through a controllable guide vane nozzle assembly 18, which controls the quantity of air entering the system determined by the power demand on the system. When the vane positions are increased, more air is allowed into the process which results in an increase in the total process flows and a corresponding increase in temperature exchange. The air mass 12 then flows past a manifold consisting of an inlet process hydrogen gas valve 20 and inlet process nitrogen gas valve 22. These valves are initially closed during start-up and are later opened when needed to control the hydrogen and oxygen content of the air mass. As the air stream leaves the compressor 10, its chemical make-up is analyzed by two separate analyzer sample lines. Oxygen sample line 24 determines the oxygen content of the air stream. Hydrogen sample line 26 is used to determine the percentage of hydrogen gas present in the air stream. The air stream then flows through an orfice plate 28, which is connected to sample line 30, which is attached to an air stream flow calculating ratio computer program controller 32. This air stream flow calculating ratio computer program controller 32 is connected to the inlet process hydrogen valve 20, the inlet process nitrogen valve 22, and the oxygen sample line 24 and the hydrogen sample line 26 by control line 37. Controller 32 functions to monitor and maintain the hydrogen to air ratio in the air stream keeping the hydrogen content less than four percent and ideally around two percent. As the air flows past the orfice plate 28, it is discharged to the atmosphere through vent valve 34. Immediately downstream from vent valve 34 is a control valve 36 which is normally closed during start-up, which allows the air stream to flow through the vent valve 34 to atmosphere establishing the systems air flow rate and pressure. When the desired constant air flow is maintained and determined by the controller 32, the controller sends a signal to the inlet process hydrogen valve 20 to open for a pre-programmed flow of hydrogen gas to enter the air stream that corresponds with the particular air flow. As the hydrogen content of the air increases, analyzer lines 24 and 26 monitor the content in connection with the controller 32. With the correct percent of hydrogen gas in the air stream established, a signal can be sent along control lines 38 and 39 to open the control valve 36 and close the vent valve 34. The air stream now flows through control valve 36, past a check valve 40 through a flame arrestor 42 and into the reaction chamber 44. The reaction chamber 44 is filled with a reactant 46 which is a hydrogenating catalyst. The catalyst could be selected from the group of platinum, palladium, silver, zirconium, rhodium, vanadium, iron, nickel, lanthanides, actinides, oxides of the preceding materials, and carbon black. When the low hydrogen content air stream comes into contact with the reactant catalyst 46, a chemical reaction takes place which bonds the metered amount of hydrogen gas to a certain percentage of the oxygen gas present in the air stream. This bonding results in a temperature rise of approximately 400 degrees Fahrenheit for each one percent oxygen bonded together from the catalytic reaction. The hot deoxidized gas stream flows from the reaction chamber 44 through an electromagnetic ferrous accumulator 48 which removes any ferrous particles from the air stream which could cause a system shut-down and then further flows through flame arrestor 50 to a heat exchanger evaporator 52. Inside the heat exchanger evaporator 52 is a working fluid 54 such as freon which exchanges heat with the hot gas stream. This heat exchange relationship causes the hot gas stream to condense, causing water to flow out drain 53. The gas stream then leaves the heat exchanger evaporator 52 and is directed back to the compressor 10 through line **53*a* through control valve 53*b*. If the system is running on atmosphere air, then control valve 53*b* will be closed and then the air stream would escape to atmosphere through drain 53. This heat exchange causes the working fluid 54 to vapoize, creating a high pressure gas stream which flows into a turbine 56 which is coupled through coupler 56*a* to a generator 58 which produces the electrical power. The hot expanding gas stream then discharges from the turbine 56 into a water-cooled heat exchanger 59 and is pumped back to the evaporator 52 by means of pump 60. Water is circulated from a cooling tower 62 by means of pump 64 through the water-cooled heat exchanger 59 to cool the expanding gas stream as it leaves the turbine. Part of the electricity that is produced can be used to run an electrolysis unit 68 which can be used to produce some or all of the hydrogen that is needed for the process which can be introduced into the system through the hydrogen control valve 20. Further, heat loss can be prevented from the process line from the reaction chamber 44 to the heat exchanger evaporator 52 by use of a vacuum jacketed line, which is well known in the art. Safety features could be readily incorporated into the process, including the use of temperature sensoring of the reaction chamber wired to a shut-down relay system for over-temperature protection of the catalyst. Other safety features well known in the art could be incorporated into the system for the hydrogen content control of the air stream to further cause an automatic shut-down of the system if the hydrogen content exceeds a predetermined amount. If the hydrogen content of the air stream is out of balance, then the controller 32 can close the control valve 36 and open the vent valve 34** to vent the air stream to the atmosphere.

This invention has been described with respect to a specific embodiment thereof. However, the invention should not be construed as limited thereto. Various modifications would be apparent to those skilled in the art and can be made without departing from the scope of this invention, which is limited only by the following claims.

We claim:

1. An electrical power plant comprising:

a reaction chamber;

a reactant in said reaction chamber;

a means for producing a pre-chamber air stream capable of undergoing an exothermic chemical reaction with said reactant to produce a post-chamber air stream at an elevated temperature;

a means for producing said pre-chamber air stream having a $H_2$/air ratio of between zero percent to four percent;

a means to monitor said pre-chamber air stream to manintain a $H_2$/air ratio of between zero percent and four percent;

a means for passing said pre-chamber air stream through said reaction chamber whereby said pre-chamber air stream and said reactant undergo an exothermic chemical reaction;

first heat exchange means;

means for passing said post-chamber air stream through said first heat exchange means;

a first working fluid in heat transfer relationship with said post-chamber air stream by means of said first heat exchange means;

a prime mover;

a generator means driven by said prime mover;

means for passing said working fluid from said first heat exchange means through said prime mover;

a generator means driven by said prime mover;

a seconod heat exchange means;

means for passing said first working fluid from said prime mover to said second heat exchange means;

a second working fluid in heat exchange relationship by means of said second heat exchange means with said first working fluid after said first working fluid passes through the prime mover;

means for returning said first working fluid back to said first heat exchange means from said second heat exchange means;

means for cooling said second working fluid.

2. The power plant of claim 1 wherein said first working fluid is a liquid hydrocarbon.

3. The power plant of claim 2 wherein said liquid hydrocarbon is freon.

4. The power plant of claim 3 wherein said reactant is selected from the group consisting of platinum, palladium, silver, zirconium, rhodium, vanadium, iron, nickel, lanthanides, actinides, oxides of the preceding materials, and carbon black.

5. The power plant of claim 4 wherein said second working fluid is ambient water.

6. A method for generating electricity comprising the steps of:

(a) producing an air stream;

(b) adding hydrogen to the air stream;

(c) maintaining the hydrogen content in the air stream to be within the range of zero to four percent;

(d) passing the hydrogen air stream over a hydrogenating catalyst, thereby producing a hot discharge air stream;

(e) vaporizing a liquid hydrocarbon by passing said hot discharge air stream through a heat exchanger in heat transfer relationship with said liquid hydrocarbon;

(f) passing said vaporized liquid hydrocarbon through a turbine;

(g) turning a generator with the turbine, thereby producing electricity.

7. The method of claim 6 wherein step (a) includes the steps of filtering out any dust particles and gases in the air stream.

8. The method of claim 7 wherein step (c) includes the step of venting the hydrogen air stream to the atmosphere if the hydrogen content is not within the range of zero to four percent.

9. The method of claim 8 wherein step (d) includes the prior step of passing the hydrogen air stream through a flame arrestor.

10. The method of claim 9 wherein step (d) includes the step of passing the hot discharge air stream through an electro ferrous accumulator to remove any ferrous material that might be present in the air stream and further passing the hot discharge air stream through a flame arrestor.

11. The method of claim 10 wherein step (d) further includes the step of preventing heat loss from the hot discharge air stream.

12. The method of claim 11 wherein step (f) further includes the step of condensing the vaporized liquid hydrocarbon from the discharge of said turbine and pumping it back to the heat exchanger.

13. The method of claim 12 wherein step (g) includes the step of supplying some of the electricity produced to an electrolysis unit for producing some or all of the hydrogen needed for the process.

* * * * *